US007140130B2

(12) United States Patent
Brooks

(10) Patent No.: US 7,140,130 B2
(45) Date of Patent: Nov. 28, 2006

(54) INSOLE WITH A NEUROMA PAD

(75) Inventor: Jeffrey S. Brooks, St. Louis County, MO (US)

(73) Assignee: Dr. Brooks Innovations, LLC, St. Louis, MO (US)

( * ) Notice: Subject to any disclaimer, the term of this patent is extended or adjusted under 35 U.S.C. 154(b) by 184 days.

(21) Appl. No.: 10/867,110

(22) Filed: Jun. 14, 2004

(65) Prior Publication Data

US 2004/0255488 A1 Dec. 23, 2004

Related U.S. Application Data

(60) Provisional application No. 60/479,138, filed on Jun. 17, 2003.

(51) Int. Cl.
*A61F 5/14* (2006.01)

(52) U.S. Cl. ..... 36/180; 36/174; 36/145

(58) Field of Classification Search ..... 36/145, 36/140, 147, 174, 176, 178, 180, 181
See application file for complete search history.

(56) References Cited

U.S. PATENT DOCUMENTS

| | | | | |
|---|---|---|---|---|
| 1,867,679 A | | 7/1932 | Reihle et al. | |
| 2,036,890 A | * | 4/1936 | Slater | 36/180 |
| 2,103,627 A | * | 12/1937 | Mirenta | 36/178 |
| 2,247,748 A | * | 7/1941 | Cotton | 36/147 |
| 2,447,954 A | | 8/1948 | Meldman | |
| 2,863,231 A | | 12/1958 | Jones | |
| 2,959,875 A | | 11/1960 | Frese, Jr. | |
| 3,148,678 A | | 9/1964 | Roberts | |
| 3,861,398 A | * | 1/1975 | Leydecker | 36/174 |
| 4,250,886 A | | 2/1981 | Riso et al. | |
| 4,272,899 A | | 6/1981 | Brooks | |
| 4,597,195 A | | 7/1986 | Dananberg | |
| 4,841,648 A | * | 6/1989 | Shaffer et al. | 36/43 |
| 5,787,610 A | | 8/1998 | Brooks | |
| 6,105,283 A | | 8/2000 | Park | |
| 4,597,195 C1 | | 1/2003 | Dananberg | |

FOREIGN PATENT DOCUMENTS

EP 0 060 353 A1 9/1982

OTHER PUBLICATIONS

European Patent Office, Partial International Search Report, Nov. 19, 2004, 3 Pages.

* cited by examiner

*Primary Examiner*—Ted Kavanaugh
(74) *Attorney, Agent, or Firm*—Senniger Powers

(57) ABSTRACT

Footwear including an insole formed for relieving pressure on a common digital nerve of a foot. The insole has heel, mid and forefoot sections. The forefoot section of the insole is formed with a pad having a neuroma pad section which underlies the third and fourth metatarsal heads of the foot, so that when a bottom of the foot is placed on the insole, the neuroma pad section applies an upward force to the bottom of the foot sufficient to spread the third and fourth metatarsal heads away from one another and thereby relieve pressure on the third common digital nerve to reduce the risk of neuroma. In other embodiments, the pad is formed as a separate pad for placement in footwear. An insole designed for use with thonged footwear is also disclosed.

18 Claims, 15 Drawing Sheets

INSOLE WITH A NEUROMA PAD

CROSS-REFERENCE TO RELATED APPLICATION

This application claims priority from U.S. Provisional Patent Application Ser. No. 60/479,138 filed Jun. 17, 2003, which is hereby incorporated by reference.

BACKGROUND OF THE INVENTION

The present invention relates generally to footwear and, more particularly, to an insole having features for improving the comfort of the foot. This invention is in the same field as applicant's prior U.S. Pat. Nos. 4,272,899 and 5,787,610, both of which are incorporated herein by reference in their entireties.

This invention is especially directed to reducing and/or preventing foot pain resulting from various afflictions, including neuritis or a neuroma. A neuroma is caused when two metatarsal bones of the foot repeatedly rub closer together, resulting in an inflammation and swelling of a common digital nerve located between the bones. A number of factors may precipitate a neuroma, including bio-mechanical abnormalities which can cause irritation during walking, running and other athletic maneuvers. Certain types of footwear which restrict natural foot movement also place a person at higher risk of developing a neuroma. Such footwear includes high heels and flat shoes such as mules, boots, flats and sandals. A foot neuroma can be very painful, and there is a need for footwear which is designed to avoid this condition or, if already existing, to remedy the problem.

Conventional footwear of the type described above can also result in incidents of stress fracture and metatarsalgia (inflammation of the ball of the foot) and/or the formation of hammertoes and/or incidents of heel pain caused by bursitis.

SUMMARY OF THE INVENTION

Among the several objects of this invention may be noted the provision of an improved insole which incorporates a special pad designed to reduce foot afflictions, including the incidence of neuroma formation; the provision of such an insole which, in some embodiments, is further designed to reduce the incidence of stress fractures and metatarsalgia, the development of hammertoes, and/or incidents of heel pain caused by bursitis; the provision of such an insole which is comfortable to wear; the provision of such an insole which, in one embodiment, is provided with markings which enable the insole to be cut to fit feet of different sizes; and the provision of such an insole which is economical to produce.

In general, footwear of the present invention includes an insole formed for relieving pressure on a common digital nerve of a foot in the third interspace. The insole comprises a heel section, a mid section and a forefoot section. A pad on the forefoot section of the insole has at least a neuroma pad section located in a region generally corresponding to an area of the foot between the third and fourth metatarsal heads. When a bottom of the foot is placed on the insole, the pad applies an upward force to the bottom of the foot in this area sufficient to spread the third and fourth metatarsal heads away from one another and thereby relieve pressure on the common digital nerve between the third and fourth metatarsal heads.

In another aspect, the invention is directed to a pad for use in footwear comprising a heel, a mid section and a forefoot section. The pad is placed in the footwear for relieving pressure on a common digital nerve of a foot in the third interspace. The pad comprises a metatarsal pad section adapted to underlie one or more of the second, third and fourth metatarsal necks of the foot, and a neuroma pad section adapted to underlie the third and fourth metatarsal heads and projecting forward from the metatarsal pad at a location between the third and fourth metatarsal heads. The arrangement is such that when the bottom of a foot is placed on the pad in the footwear, the neuroma pad section of the pad applies an upward force to the bottom of the foot to spread the third and fourth metatarsal heads away from one another and thereby relieve pressure on the common digital nerve between the third and fourth metatarsal heads.

In another aspect of this invention, an insole is adapted for use with footwear comprising a sole and at least one thong extending up from the sole for reception in an interspace between two adjacent toes of a foot on the sole. The insole comprises a heel section, a mid section, a forefoot section, and slot-defining means on the insole defining at least one slot extending generally rearwardly from a front edge of the forefoot section at a location corresponding to said at least one thong.

Other objects and features will be in part apparent and in part pointed out hereinafter.

BRIEF DESCRIPTION OF THE DRAWINGS

Corresponding parts are designated by corresponding reference numbers throughout the drawings.

DETAILED DESCRIPTION

Figure 1:
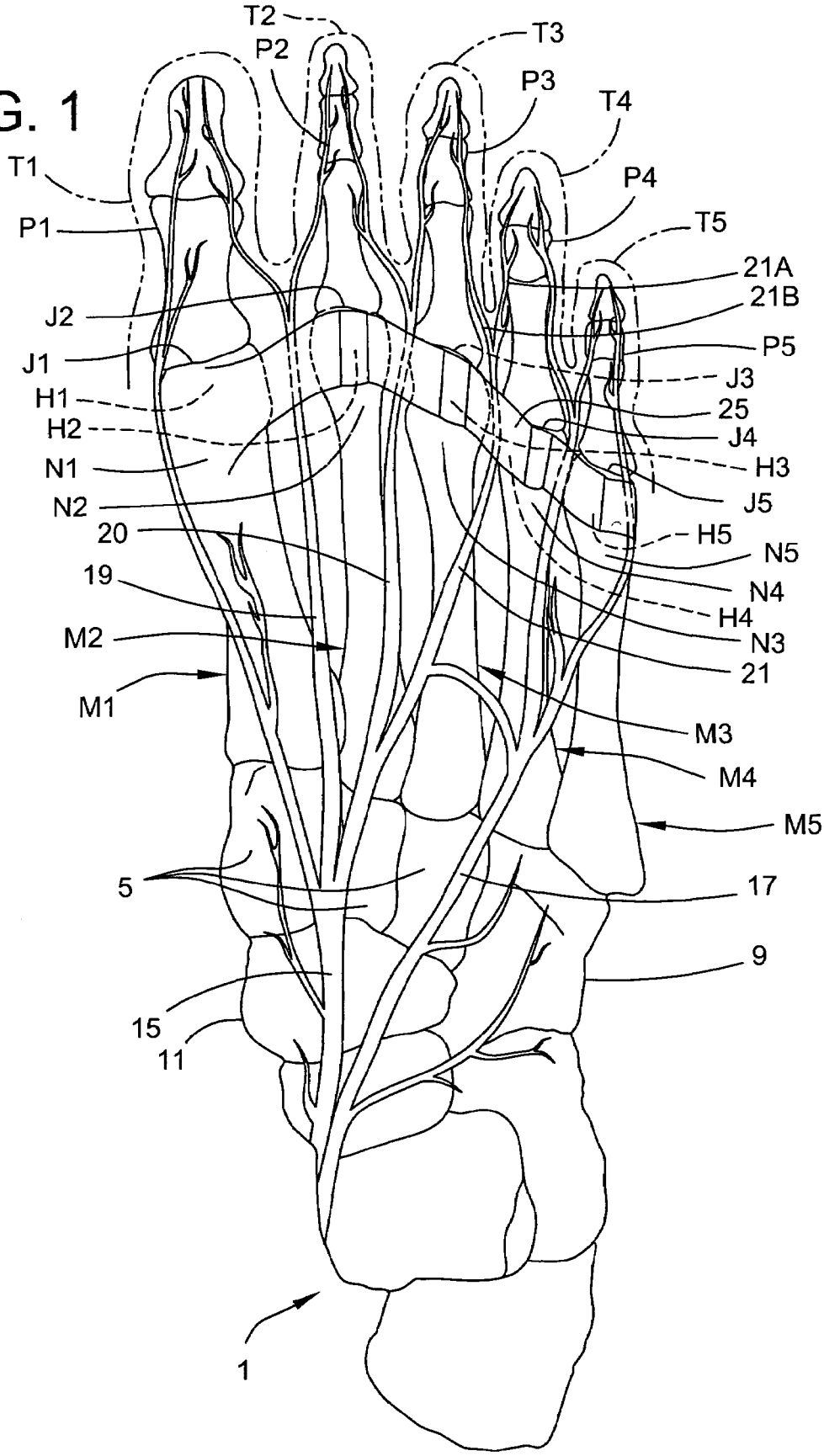
FIG. 1 is a bottom or plan plan view of a foot showing relevant bones and nerves.
Figure 3:
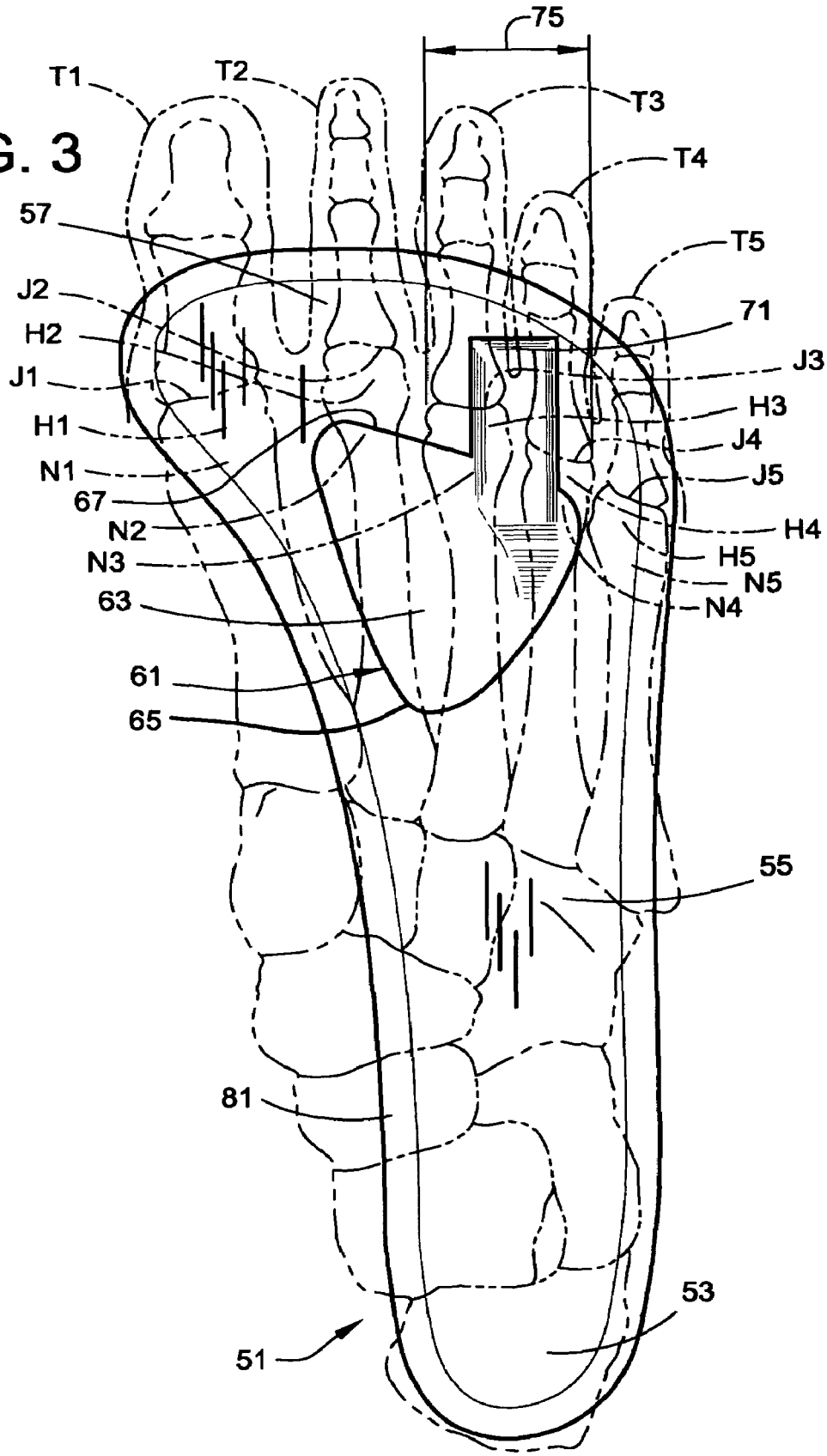
FIG. 3 is a top plan view similar to FIG. 2 but with the foot of FIG. 1 superposed in phantom over the metatarsal pad and neuroma extension of the insole of FIG. 2 to show the relative position of the foot and the insole.

FIGS. 1 and 3 of the drawings shows the bone and nerve structure of a foot which is designated in its entirety by the reference numeral 1. As shown, the foot has a heel, a midfoot, and a ball which includes metatarsals M1–M5, metatarsal necks N1–N5 and metatarsal heads H1–H5. The front of the foot includes five toes T1–T5 formed by phalanges P1–P5 extending forward from respective metatarsal phalangeal joints J1–J5. (The phalange P1 of the big toe T1 includes proximal and distal bones, and the phalange of each of the other four toes T2–T5 includes proximal, middle and distal bones.) Also shown in FIG. 1 are cuneiform bones and cuboid bone, indicated at 5 and 9, respectively, and the navicular bone 11. Medial and lateral plantar nerves 15, 17 extend forward on the foot, and the medial plantar nerve 15 divides to form the first common digital nerve 19, the second common digital nerve 20, and the third common digital nerve 21, with each common digital nerve extending between respective metatarsals of the foot. The third common digital nerve 21 lies between the third and fourth metatarsals M3, M4. As shown, this nerve 21 runs below a ligament 25 (sometimes referred to as the deep transverse intermetatarsal ligament) extending between the metatarsal heads H3 and H4 and divides to form branches 21*a*, 21*b* to the third and fourth toes of the foot.

During walking and running, the lateral (outside) portion of the heel is generally the first part of the foot to strike the ground, with the foot then pivoting on the heel to bring the lateral part of the forefoot, including the fourth and fifth metatarsal heads H4 and H5, into contact with the ground to stabilize the foot. At this point, the foot is supinated (inclined upwardly from the lateral to the medial side of the foot), but rapidly pronates to a neutral position in which the bottom of the heel and metatarsal heads H1–H3 (see FIGS. 1 and 3) of the forefoot are in contact with the ground, and in which the central vertical plane of the heel is ideally generally perpendicular to the ground. During this sequence of movements, the medial column of the foot (including the talus bone, navicular bone 11, cuneiform bones 5 and metatarsals M1–M3) shifts forward relative to the lateral column of the foot (including the heel bone, cuboid bone 9 and metatarsals M4–M5). In addition, various muscles and tendons contract to stabilize the foot in preparation for movement from the neutral position back to a supinated position prior to the propulsive phase of the gait cycle. (The propulsive phase is sometimes referred to as toe-off or push-off.) The midfoot should be firmly supported when the foot is in the neutral position in order to prevent the ligaments, muscles and tendons from becoming over stressed. During toe-off, it is preferable that the second and third metatarsals M2 and M3 be firmly supported, and that the first metatarsal head H1 plantarflex (move downward) relative the second and third metatarsal heads H2, H3. The toes also should be firmly supported during push-off so that they remain straight and thus stronger due to the pillar effect of the phalanges P1–P5.

Repetitive shifting of the lateral and medial columns relative to one another can cause the third common digital nerve 21 to become inflamed and swollen, causing a painful neuroma. Similarly, a neuroma can result from wearing shoes which restrict the natural movement of the foot. For example, depending on the size of the toe box, high heels and flat shoes may tend to cause pinching of the third common digital nerve 21 between metatarsal heads H3 and H4. Further, some feet can be predisposed for the formation of a neuroma, as when the third common digital nerve 21 rubs against the deep transverse intermetatarsal ligament 25.

Figure 2:
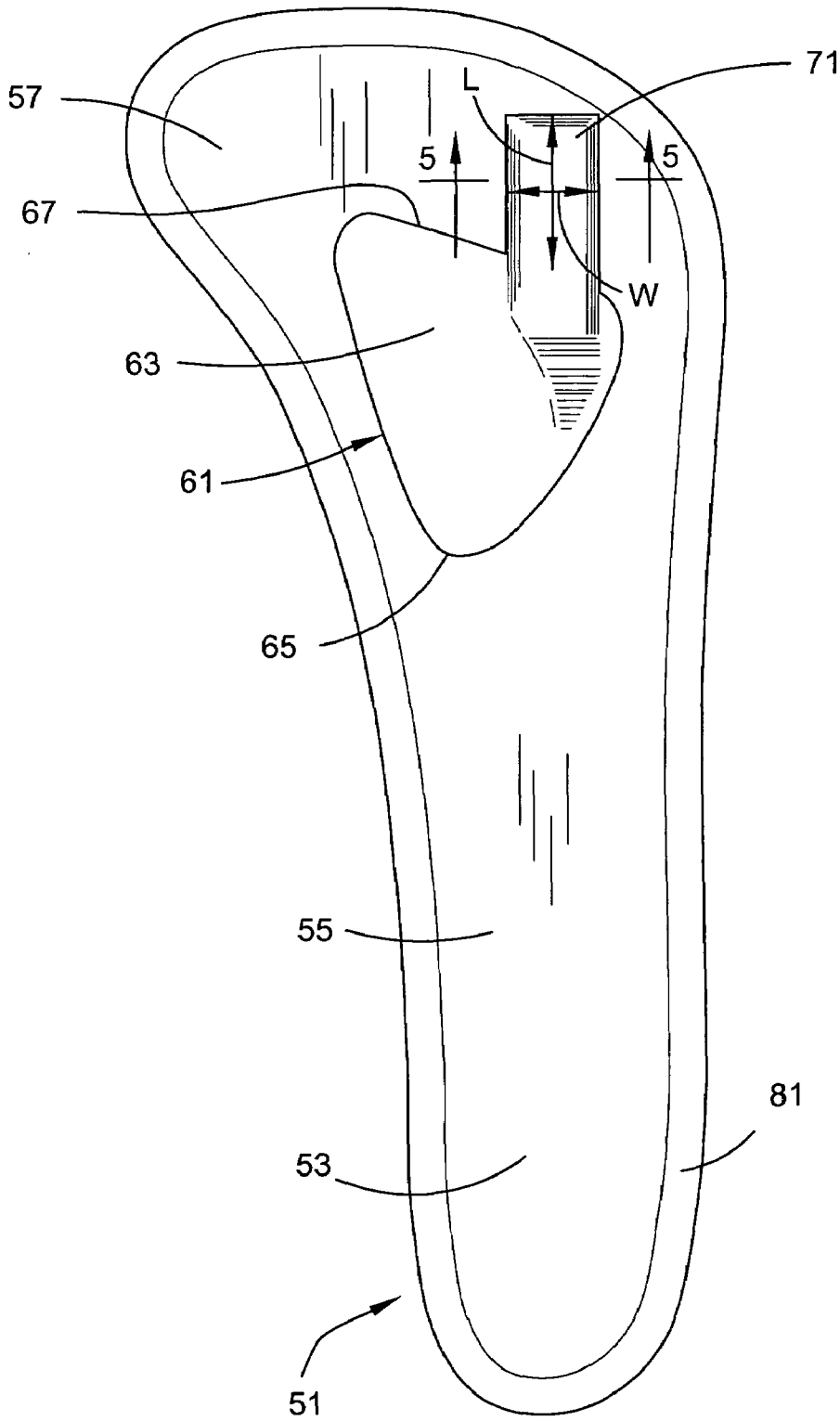
FIG. 2 is a top plan view of one embodiment of an insole of the present invention incorporating a metatarsal pad having a neuroma extension.
Figure 4:
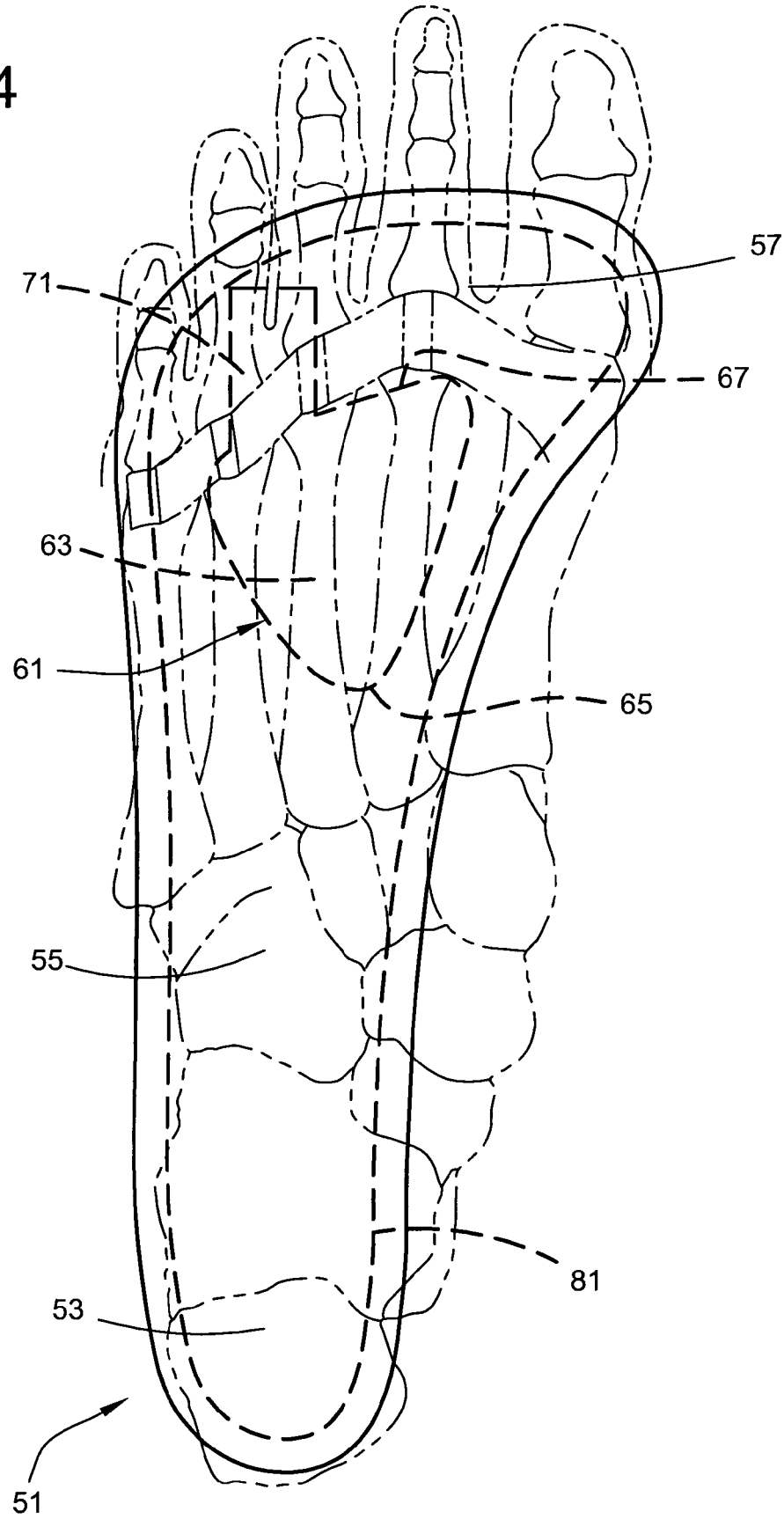
FIG. 4 is a bottom plan view of FIG. 3.

FIGS. 2–4 show one embodiment of the present invention in the form of footwear comprising an insole, generally designated 51. The insole has a heel section 53 for reducing shock in the heel of a foot, a mid section 55 for dampening mid-foot strain, and a forefoot section 57 for providing additional protection to the ball of the foot, including the first, second, third, fourth and fifth metatarsal heads H1–H5 and tissues of the foot, and the toes T1–T5 of the foot. (The positions of the insole and parts of the insole in relation to the parts of the foot are seen in FIGS. 3 and 4.) The upper surface of the insole 51 is formed with a raised pad, generally indicated at 61, having a metatarsal pad section 63. This section of the pad generally has the shape of a triangle with rounded corners. Relative to a foot on the insole, the apex of the triangle, indicated at 65, underlies the proximal ends of the second and third metatarsal necks N2–N3 and diverges forward toward the front of the foot, terminating at a front edge 67 underlying the second, third and fourth metatarsal necks N2–N4 immediately proximal of the respective metatarsal heads H2–H4. The metatarsal pad section 63 applies pressure to the metatarsal necks and functions to stabilize the metatarsal phalangeal joints J2–J4. The pad also reduces excessive contraction of tissues of the foot (e.g., the tendons on the top of the foot) and allows the toes to lie flat for proper toe-off, thus helping to prevent the formation of hammertoes.

Figure 5:
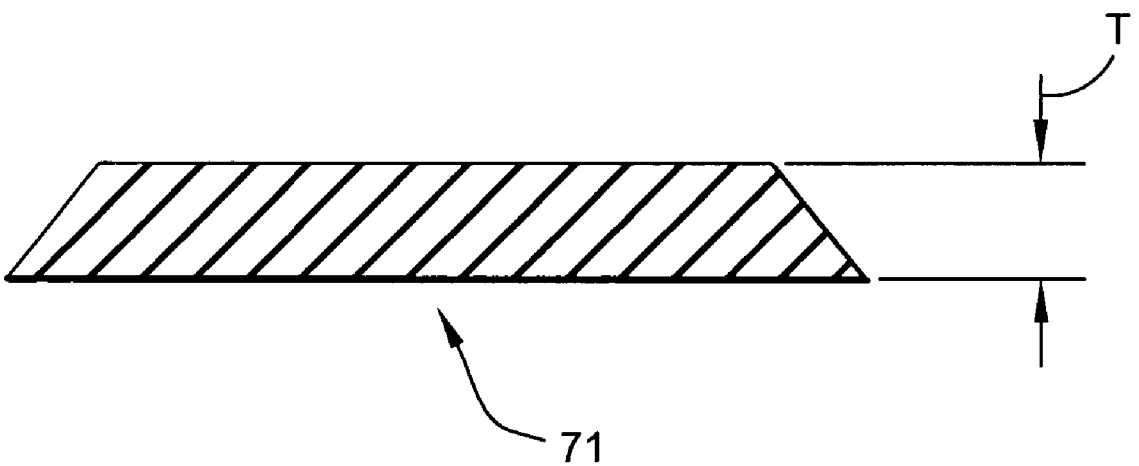
FIG. 5 is a sectional view along the line 5—5 of FIG. 2.

The pad 61 also includes a neuroma pad section 71 having opposite sides projecting in a forward direction from the front edge 67 of the metatarsal pad section 63 in a region generally corresponding to an area of the foot between the third and fourth metatarsal heads H3–H4. The neuroma pad section 71 is elongate and, in one embodiment (FIG. 2), generally rectangular in shape, projecting in a direction generally parallel to the third and fourth toes T3–T4. In this embodiment, the neuroma pad section 71 has a width W which is only slightly more than the spacing between the third and fourth metatarsal heads, and a length L such that it extends beyond the metatarsal phalangeal joints J3–J4. (Width W and length L are identified in FIG. 2.) Thus, as shown in FIG. 3, the width of the neuroma pad section 71 is less than the combined widths of the third and fourth metatarsal heads H3–H4 or, stated another way, the width of the neuroma pad section 71 is greater than the spacing between the third and fourth metatarsal heads but less than the distance 75 across the third and fourth metatarsal heads. By way of example, section 71 may have a length L of 2.0 cm plus or minus 5.0 mm, depending on the size of the foot, and section 71 may have a width W of 1.0 cm plus or minus 5.0 mm, depending on the size of the foot. As shown in FIG. 5, the neuroma pad section has a planar top surface and the side edges of the neuroma section 71 are tapered inwardly from bottom to top so that the pad wedges into proper position between the third and fourth metatarsal heads H3, H4. The thickness T of section 71 (FIG. 5) is generally uniform over its length L and is may be about 0.32 cm plus or minus 1.6 mm, again depending on the size of the foot.

The configuration of the insole 51 is such that when a bottom of the foot is placed on the insole, the neuroma pad section 71 of the pad 61 applies an upward force to the bottom of the foot in the stated area between the third and fourth metatarsal heads H3–H4 sufficient to spread these heads away from one another and thereby relieve pressure on the third common digital nerve 21 located between the third and fourth metatarsal heads. The neuroma pad section 71 is particularly effective for protecting the foot in the region of the third common digital nerve 21 between the third and fourth metatarsal heads H3–H4 during the propulsive phase of the gait. By relieving the pressure on this nerve, the risk of neuroma is reduced substantially. The insole is particularly effective for reducing incidence of neuroma when used in high heel shoes and flat shoes, although it may be beneficially used in any type of footwear.

The metatarsal and neuroma pad sections 63, 71 can be formed integrally with the insole so that the entire structure is a single molded part. Alternatively, the two pad sections 63, 71 can be formed as a unit separate from the insole 51 and then attached as a unit to the insole, either at the time of manufacture or later by a person requiring use of the pad. In another embodiment, the metatarsal and neuroma pad sections 63, 71 can be formed separate from one another and then attached to the insole, either at the time of manufacture or later by a user of the insole. In still other embodiments, the pad 61 or, optionally, either or both sections 63, 71 of the pad individually, can be incorporated as an integral part of the sole of footwear, or purchased separate from the footwear and then installed in the footwear, as needed.

As shown in FIGS. 2–4, the peripheral edge of the top surface of the insole 51 is skived, as indicated at 81, so that the insole tapers down to the edge. This construction allows the insole to lie flatter in a shoe, boot or other footwear.

The insole shown in FIGS. 2–4 is sized for placement in footwear after the footwear has been manufactured, and thus has an overall length less than the length of the foot. However, it is contemplated that the insole may be a full-length insole which is incorporated in the footwear at the time of manufacture.

The insole 51 and pad 61 may be made from any suitable insole materials, such a polyurethane (e.g., TPU) having a durometer in the range of about 45–90 (OO Scale), an exemplary narrower range of about 50–80 (OO Scale), and an even narrower exemplary range of about 65–70 (OO Scale). Alternatively, the insole 51 and pad 61 may be made of a silicone material having a durometer in the range of 45–90 (OO Scale), an exemplary narrower range of about 50–80 (OO Scale), and an even narrower exemplary range of about 65–70 (OO Scale). Optionally, the material may be treated with a suitable anti-microbial bacterial agent, such as is commercially available from Greenchem Corporation of Taiwan, ROC, under the trade designation BIOFOAM (ATMB-68). Other insole and pad materials may be used.

Figure 6:
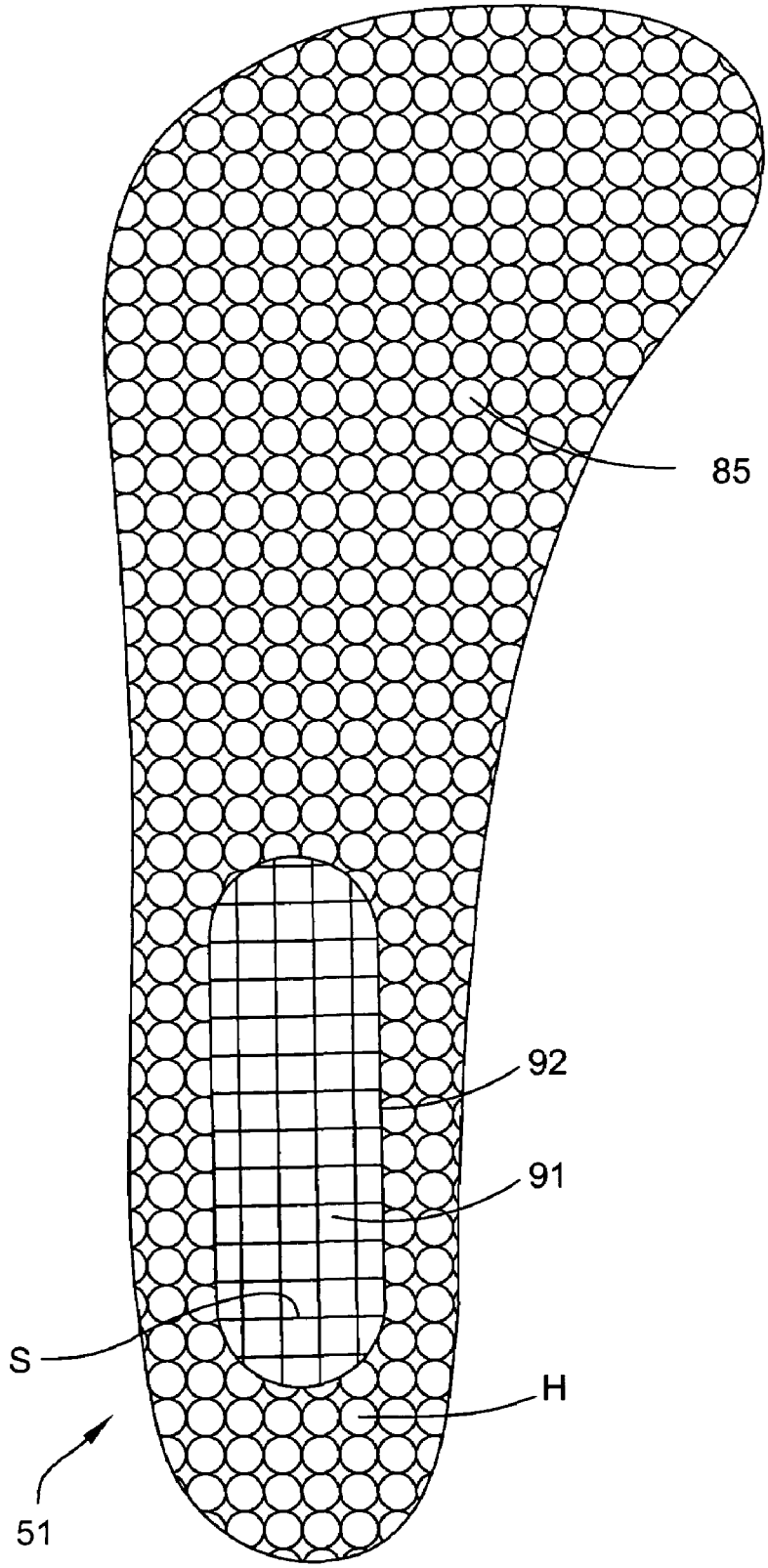
FIG. 6 is a bottom plan view of FIG. 2 showing cushioning elements of the insole.
Figure 7:
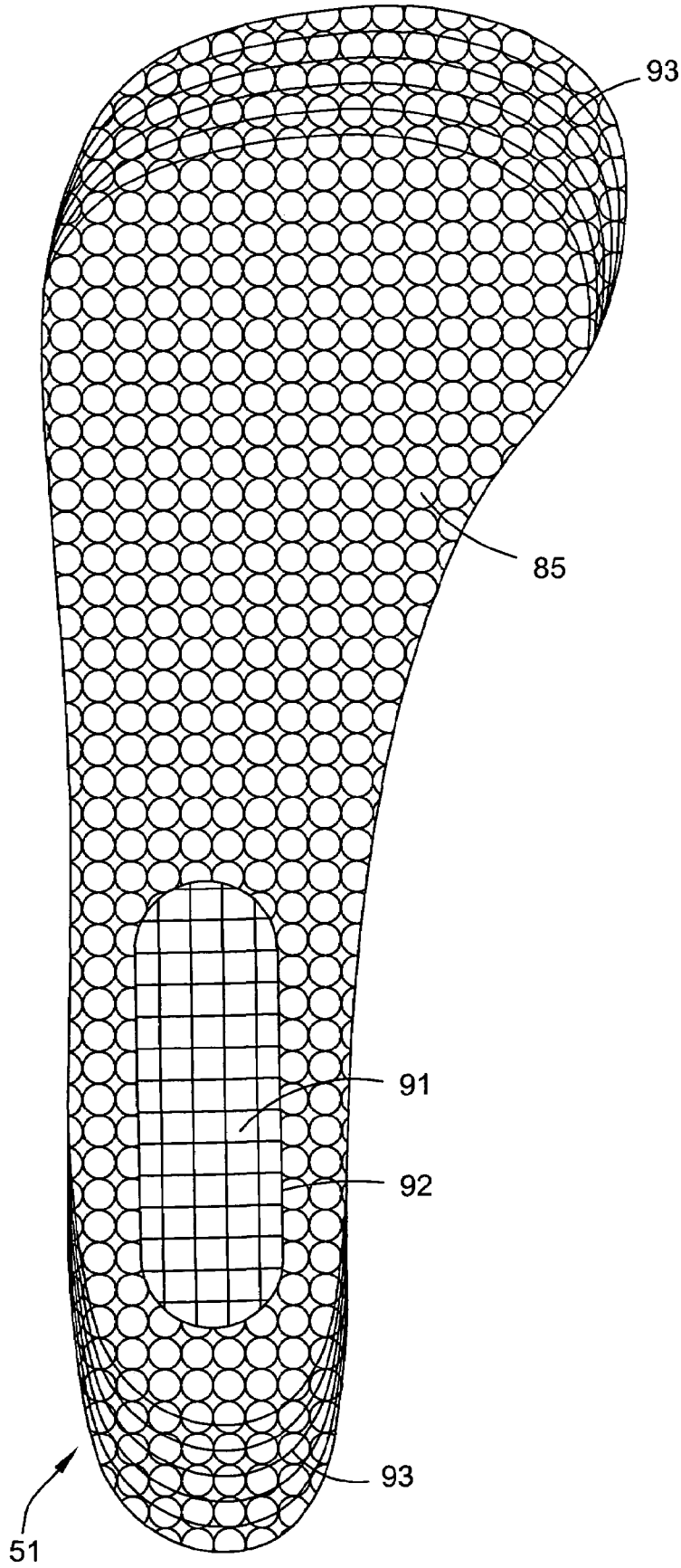
FIG. 7 is a bottom plan view similar to FIG. 6 but showing markings on the insole defining cut lines for reducing the size of the insole to fit a particular foot.

In the embodiment shown in FIGS. 6 and 7, the bottom of the insole 51 is formed with a multiplicity of cushioning elements 85 covering substantially the entire bottom surface of the insole. These cushioning elements 85 function to dampen impact forces during walking and running. The specific configuration of the cushioning elements is not critical, provided they achieve the cushioning function. In one embodiment, the cushioning elements 91 in the heel area 92 are configured (e.g., less dense) to provide more cushioning than other parts of the insole. For example, the cushioning elements in the heel area may be formed with more cellular space, or from softer material to provide the additional cushioning. This additional cushioning assists in the prevention of bursitis in the heel area. The cushioning elements may be molded as integral parts of the insole.

Optionally, the top surface of the insole 51 in the area of the pad section 63 and the heel area 92 are formed with short closely-spaced projections (not shown) which function to massage the foot in these areas when walking or running to increase circulation and help prevent inflammation and soreness. The projections may be of any suitable shape, e.g., finger-like projections of circular cross section.

As shown in the exemplary embodiment in FIG. 7, the edges of the insole have cut lines 93 for reducing the size of the insole to fit a particular foot or footwear. The cut lines can be on the forefoot section of the insole only, or on the heel section only, or on both the forefoot and heel sections, as illustrated. (As used herein, the term "line" is intended to include a single continuous line or a series of disconnected lines defining an area to be removed.) The cut line can be molded into the top and/or bottom surface of the insole as a groove, line of weakness or the like, or it can simply be a marking on the insole.

If desired, the insole can include a fabric cover or sock liner, not shown.

Figure 8:
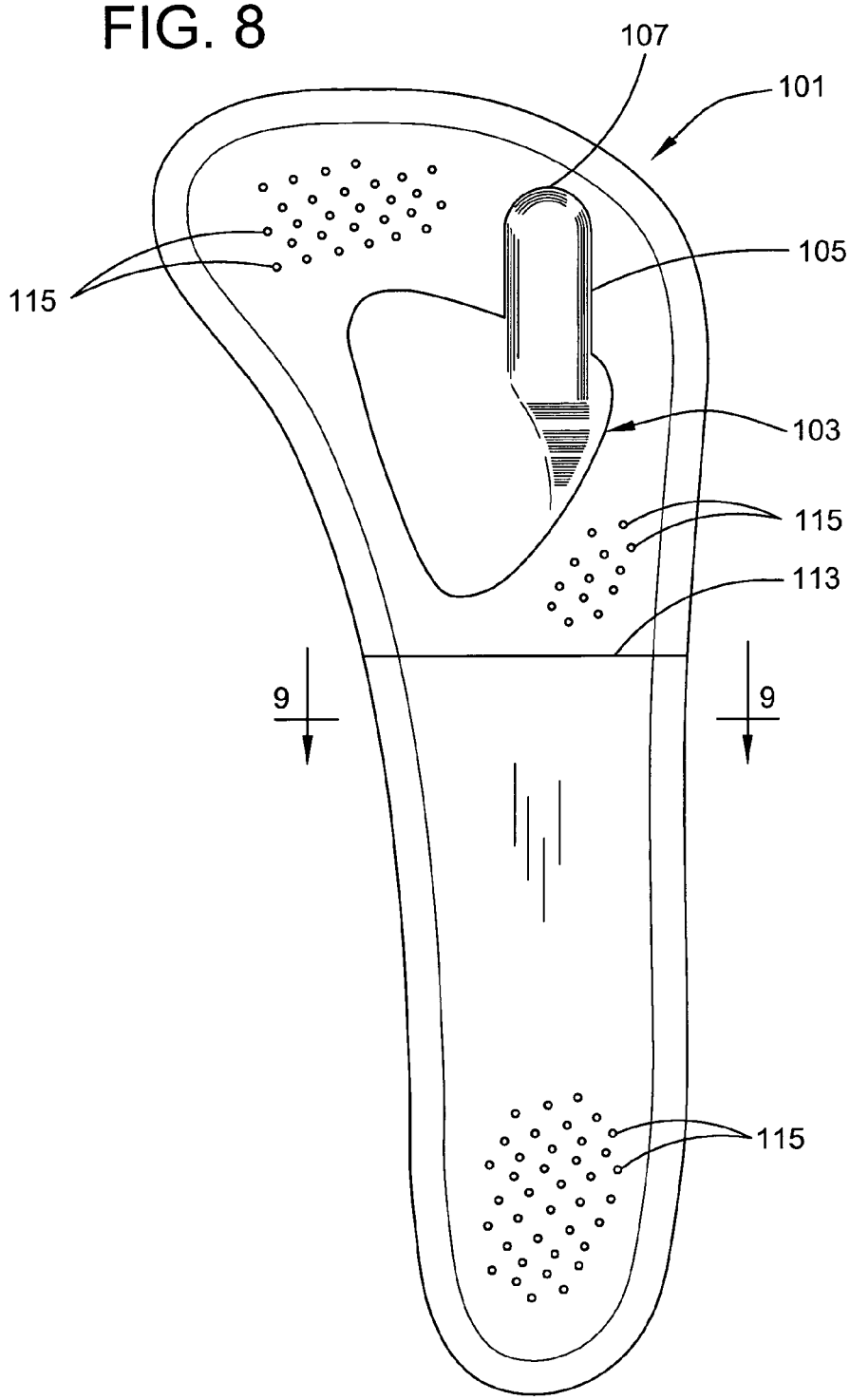
FIG. 8 is a top plan of a second embodiment of an insole of this invention.

FIG. 8 shows a different embodiment of an insole, generally designated 101, having a pad 103 with a neuroma pad section 105 similar to the pad 61 and pad section 71 described above. In this embodiment, the front distal edge of the neuroma pad section 105 is rounded, as indicated at 107. Alternatively, edge 107 can be tapered or have other shapes. The insole also has a cut line 113 extending generally transversely of the insole. (As used herein, the term "line" is intended to include a single continuous line or a series of disconnected lines defining an area to be removed.) The insole may be cut along this line to separate the forefoot and heel sections of the insole from one another so each can be used separate from one another, if desired. The cut line can be molded into the top and/or bottom surface of the insole as a groove, line of weakness or the like, or it can simply be a marking on the insole. Small vent holes 115 through the insole may also be provided at suitable locations to allow heat and perspiration from the foot to escape and the foot to "breathe".

Figure 9:
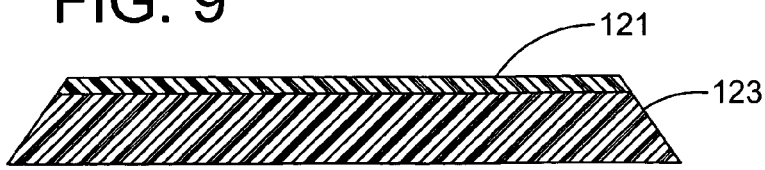
FIG. 9 is a sectional view on line 9—9 of FIG. 8.

FIG. 9 is a cross-sectional view illustrating one embodiment of the insole 101 as being fabricated in two layers, i.e., an upper layer 121 and a lower layer 123. The lower layer 123 may be formed of a "sticky" or "tacky" or "self-adhering" material having non-slip characteristics to hold the insole fixed in the footwear, and the upper layer 121 may be formed of a material which will not stick to the skin. By way of example, the two layers may be fabricated from different types of polyurethane material using the well-known pour molding technique. Suitable materials are commercially available from Polymer Dynamics, Inc. of Allentown, Pa. (at www.polymerdynamics.com), for example. Other self-adhering cushioning materials are disclosed in U.S. Pat. No. 5,539,020.

Alternatively, the bottom layer may be molded and the top layer sprayed on or adhesively applied as a sheet of appropriate non-stick material. Further, the top layer may be textured over some or all of the area exposed to the foot to reduce slippage.

Figure 10:
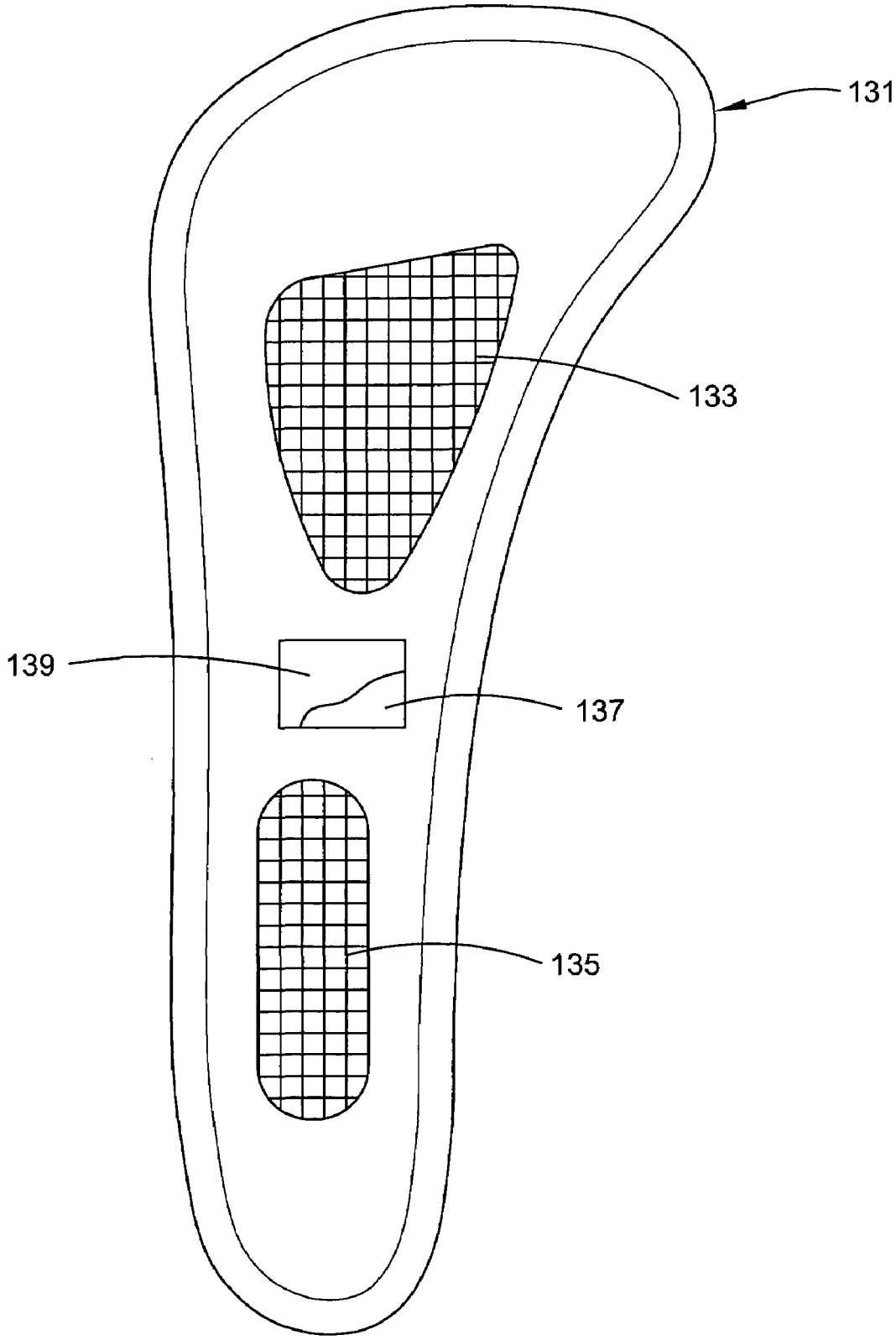
FIG. 10 is a bottom plan of an insole.

FIG. 10 shows another embodiment of a bottom of an insole generally designated 131, it being understood that the top of the insole is formed with a neuroma pad of this invention. As shown, the forefoot area 133 and a heel area 135 of the bottom of the insole 131 are textured to provide anti-slip properties to hold the insole against slippage when it is placed in a shoe or other footwear. The texturing may have any suitable pattern and/or roughness sufficient to perform its intended function. Further, other areas of the bottom may be textured, or the entire bottom surface may be textured.

Optionally, a suitable adhesive may be applied to the bottom of the insert 131. In FIG. 10, adhesive is applied to the insert over a rectangular area 137 of the insole between the textured areas 133, 135. The adhesive area may be covered by a removable patch 139 (a portion of which is broken away in FIG. 10 to show the adhesive area 137). The patch is removed prior to placement of the insole into the footwear. One or more such adhesive areas may be used in lieu of or in addition to one or more of the textured areas to provide non-slip characteristics to the bottom of the insole.

Figure 11:
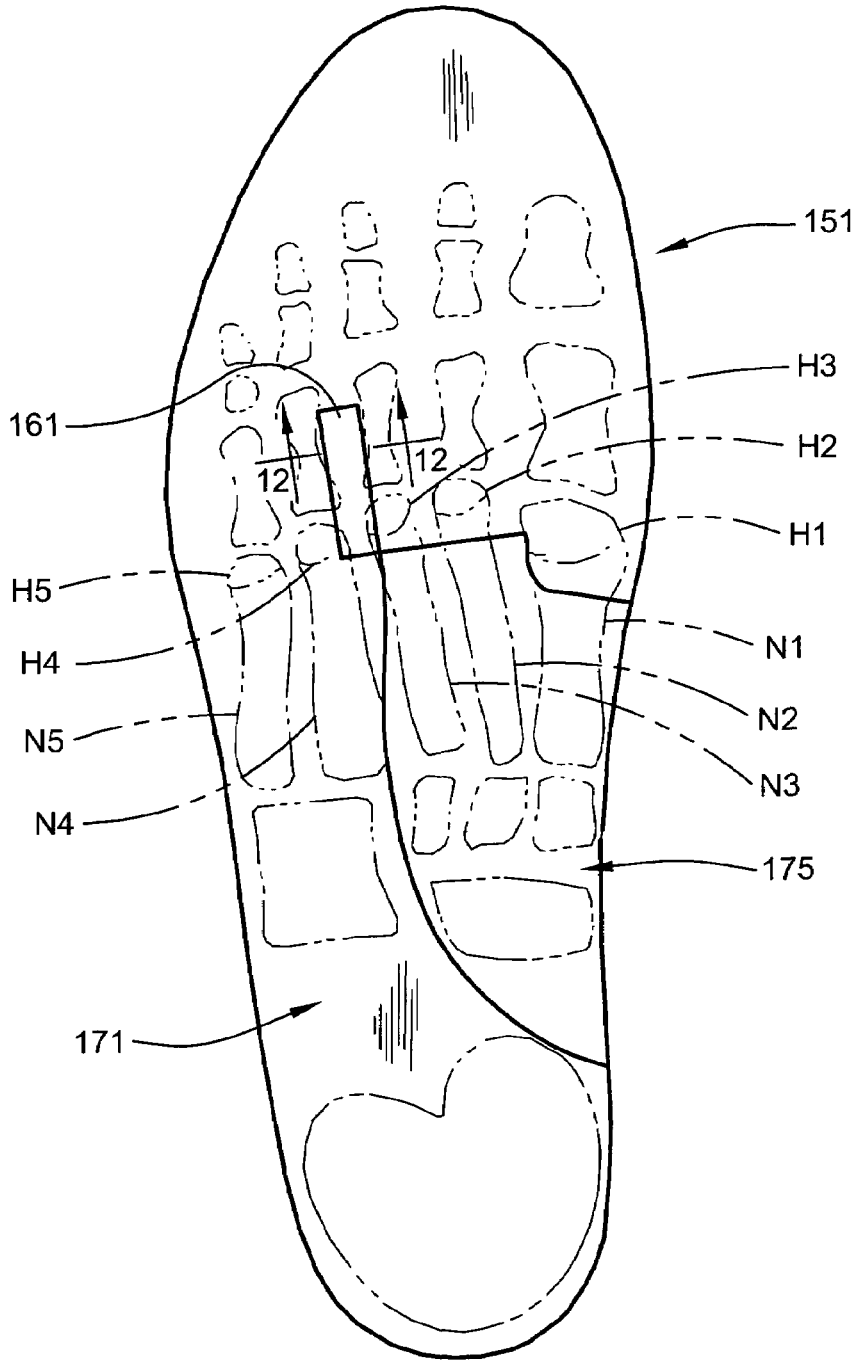
FIG. 11 is a top plan of a full-foot insole incorporating a neuroma pad and a "7"s design.

A neuroma pad (e.g., 61, 103) of this invention may also be incorporated as part of a full-foot insole having one or more the features of my U.S. Pat. Nos. 5,787,610 and 5,964,046, both of which are incorporated herein by reference. (As used herein, a "full-foot insole" is an insole which extends substantially the full length of the foot.) These features appropriately support and cushion the various parts of a user's foot, as by permitting the first metatarsal head H1 to plantarflex relative to the second and third metatarsal heads H2, H3 during toe-off, and by supporting and cradling the osseous structure of the foot to maintain the neutral position after pronotion. FIG. 11 illustrates one embodiment of such an insole, generally designated 151, having the "7"'s design described in my previous patents and an exemplary neuroma pad 161 of this invention. The neuroma pad can be incorporated as part of the insole 151 in different ways, as by molding the pad as an integral part of the insole, or by forming the pad as a separate piece and then attaching it to the insole, using a suitable adhesive for example. The neuroma pad can be attached to the top or bottom surface of the insole.

In the "7"'s design noted above, the full-foot insole 151 has a first resilient and compressible portion 171 having a shape roughly resembling a numeral seven for attenuating shock during running and walking, and a second resilient and compressible portion 175 harder (more resistant to compression) than the first portion 171 for providing firm support for the foot during running and walking. The first portion 171 comprising at least part of a lateral region of the heel section, at least part of a lateral region of the mid section, and a region of the forefoot section supporting the first, second, third, fourth and fifth metatarsal heads, associated phalanges and metatarsal phalangeal joints, and the metararsal neck N5 associated with the fifth metatarsal head. The second portion 175 comprises at least part of the medial region of the mid section and a region of the forefoot section supporting at least one of the metatarsal necks N2, N3 associated with the second and third metatarsal heads H2, H3.

The first portion 171 may be made of a polyurethane material having an Asker C durometer in the range of 10–30, for example. The second portion 175 may be made of a polyurethane material having an Asker C durometer in the range of 30–70, for example. For additional details regarding this construction, reference may be made to the aforementioned U.S. Pat. Nos. 5,787,610 and 5,964,046.

Figure 12:
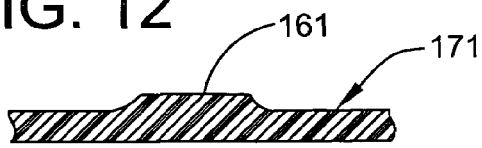
FIG. 12 is a sectional view on line 12—12 of FIG. 11.

In the embodiment of FIG. 11, the neuroma pad 161 is a smaller pad having a shape and dimension generally corresponding to the pad section 71 (or 105) described above. The neuroma pad 161 may be formed of the same material which forms the compressible portion 171 of the insole. The pad 161 may be integral with compressible portion 171, as illustrated in FIG. 12, or it may be a separate piece secured (e.g., adhesively) to portion 171.

In another embodiment, a neuroma pad of this invention may be incorporated as part of a full-foot insole having other configurations (e.g., a thin, flat, generally planar insole not having the "7"'s design referred to above).

It will be observed from the foregoing that a neuroma pad (or pad section) of this invention is very versatile, and that it functions to reduce and/or prevent foot pain caused by neuritis or a neuroma. Further, in certain embodiments, the metatarsal pad (or pad section) protects the ball of the foot to reduce pain and help prevent the development of hammertoes and neuromas. The forefoot section of the insole of some embodiments may be designed to shape to the foot automatically, creating an efficient, impact-absorbing platform. The arch support of the insole of certain embodiments may be designed to cradle the arch to reduce pronation, strain and fatigue, plantar fasciitis of the heel, and shin splints. The heel section of the insole of certain embodiments may be designed to cushion and suspend the heel from impact to the bursa of the heel, while reducing impact shock waves to the knee, hop and lower back. An insole of exemplary embodiments of this invention may include virtually any combination of these features.

Figure 13:
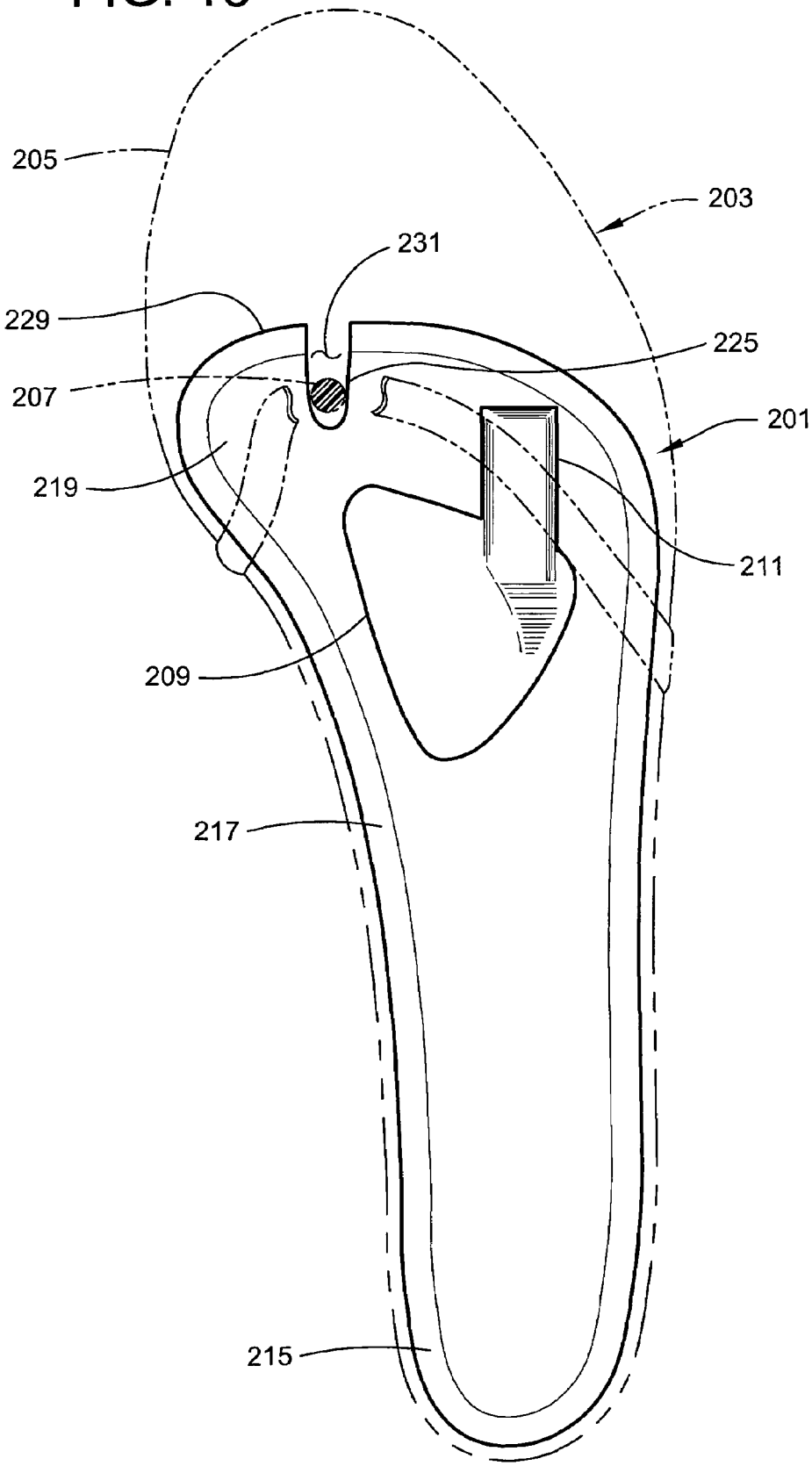
FIG. 13 is a plan view of one embodiment of an insole of this invention adapted for use with thong footwear.

FIG. 13 illustrates an insole, generally designated 201, adapted for use with thong footwear (shown in phantom at 203). The footwear 203 is of the type comprising a sole 205 and at least one thong 207 extending up from the sole for reception in an interspace between two adjacent toes of a foot on the sole. Examples of thong footwear include sandles and certain high-heels. The insoles designed for this type of footwear may or may not include one or more of the various neuroma, metatarsal and heel pads described above. For illustration purposes, the insole 201 includes a metatarsal pad 209 with a neuroma pad section 211 of the type described above.

More specifically, the insole 201 shown in FIG. 13 comprises a heel section 215, a mid section 217, a forefoot section 219, and slot-defining means 225 on the insole extending generally rearwardly from a front edge 229 of the forefoot section at a location corresponding to the thong 205. In the embodiment shown in FIG. 13, the slot-defining means comprises a U-shaped slot edge (also designed 225) which defines a slot opening 231 in the insole for receiving the thong 205 extending up through the interspace between the first ("great") toe and the second toe. Alternatively, the slot-defining means 225 could be a cut line which defines an area to be cut to form the slot opening 231. (As used herein, the term "line" is intended to include a single continuous line or a series of disconnected lines defining an area to be removed.) The cut line can be any type of visual indicator on the top and/or bottom surface of the insole, such a printed boundary, one or more depressions (e.g., groove), or area of weakness. In any event, the slot opening 231 can be of any appropriate width. For example, it could be a slit having virtually no width, or a much wider opening. The length of the slot opening may also vary. In the illustrated embodiment, the slot opening 231 extends to a location corresponding approximately to the web of the foot defining the closed end of the interspace between the first and second toes.

Figure 14:
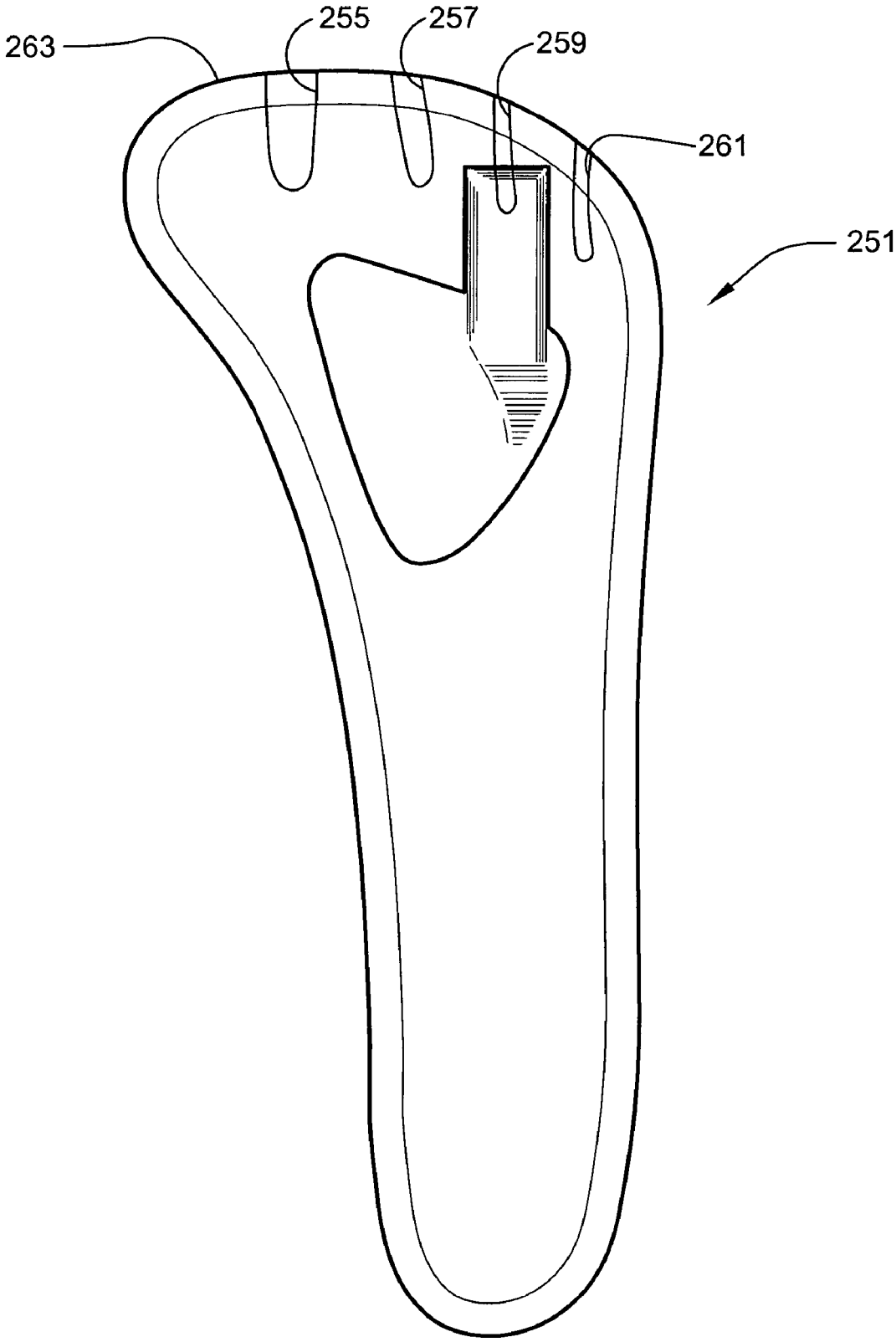
FIG. 14 is a plan view of a second embodiment of an insole adapted for use with thong footwear.

FIG. 14 shows an insole, generally designated 251, similar to the insole 201 of the previous embodiment except that the slot-defining means comprises a plurality of cut lines 255, 257, 259 and 261 defining a corresponding number of slot openings in the insole extending rearward from the front edge 263 of the insole. The number of slot openings defined by the cut lines may vary. The cut lines indicate where the insole 251 is to be cut to form one or more of the slot openings, depending on the number and location of the one or more thongs of the footwear. As noted previously, the cut lines can be of any suitable form defining areas to be removed to form one or more slot openings. It will be noted that the depth of these slot openings vary in a way which generally corresponds to the depth of the interspaces between the toes.

The insoles 201, 251 described above are adapted for use with footwear having many types of thong construction, including a type where one or more foot straps are connected to one or more posts extending up from the outsole, and a type where one or more foot straps are connected directly to the sole.

Figure 15:
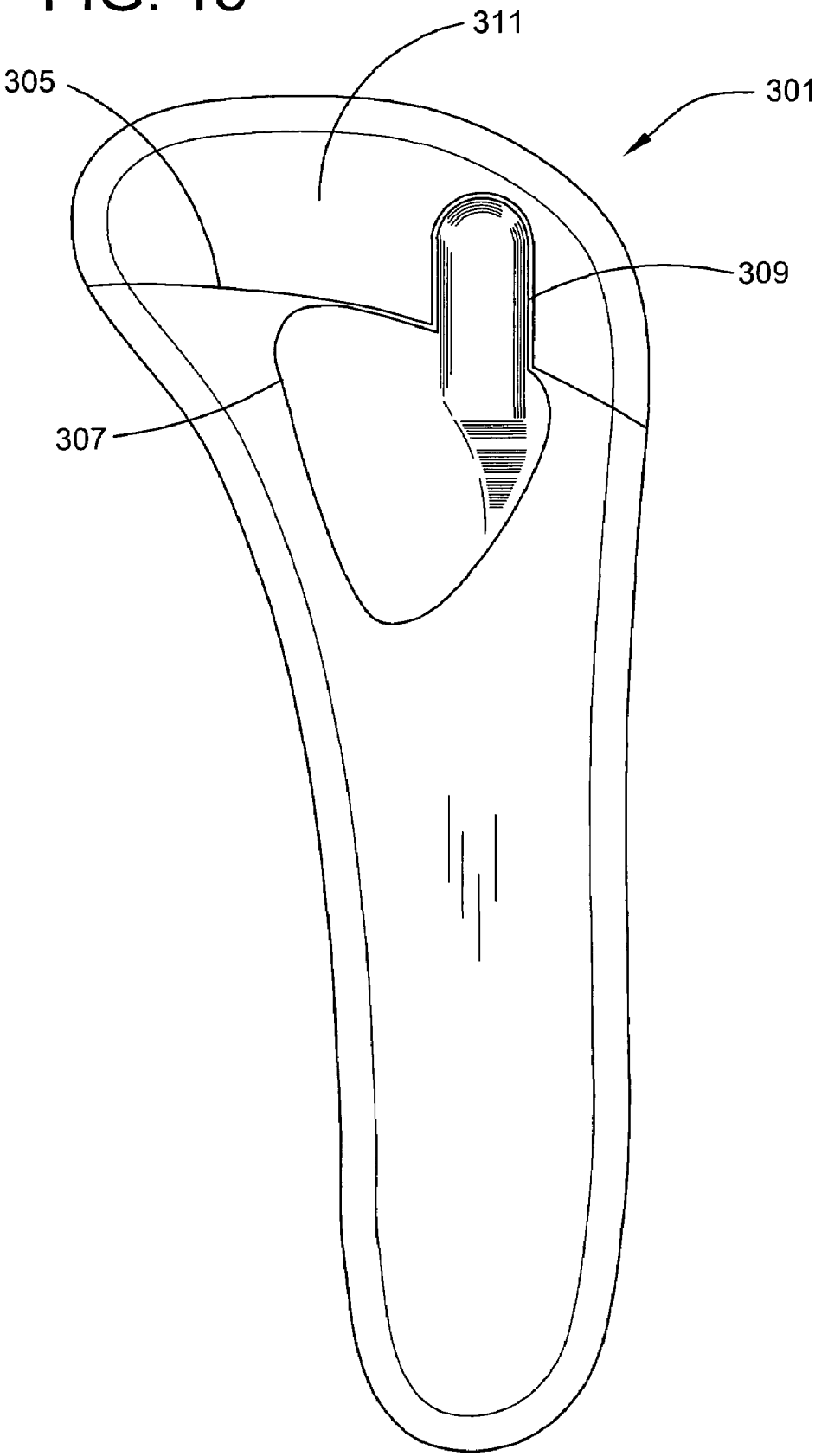
FIG. 15 is a plan view of another embodiment of an insole of this invention.

FIG. 15 illustrates a different insole embodiment of this invention, generally designated by the reference number 301. This insole in generally similar to the insole of the first embodiment, except that it includes a cut line 305 extending laterally across the forefoot section of the insole immediately forward of the metatarsal pad 307 and neuroma pad section 309. (As used herein, the term "line" is intended to include a single continuous line or a series of disconnected lines defining an area to be removed.) The cut line can be molded into the top and/or bottom surface of the insole as a groove, line of weakness or the like, or it can simply be a marking on the insole. By cutting along this line, the front part of the insole 311 can be removed. This may be desirable, for example, where the insole is to be used with footwear (e.g., high heels) having smaller toe boxes. In such cases, removing the front part 311 of the insole provides more space in the toe box for greater comfort while still affording the advantages of this invention (e.g., reducing and/or preventing foot pain resulting from various afflictions, including neuritis or a neuroma).

Also, in regard to the embodiment of FIG. 15, the line 305 may also represent a boundary which separates different compositions of the footwear. For example, the material out of which the insole is made forward of the line 305 may be a softer, more cushioning material (i.e., less resistant to compression) than the material rearward of the line, thus providing greater shock absorption for the front of the foot in cases where this may be desirable, as for high heels. Also, where the toe box of the footwear is smaller, the softer material is more compressible to provide more room for the foot. By way of example, but not limitation, the material forward of the line may be of a polyurethane e.g., TPU, having a durometer in the range of up to about 10 (OO Scale).

Figure 16:
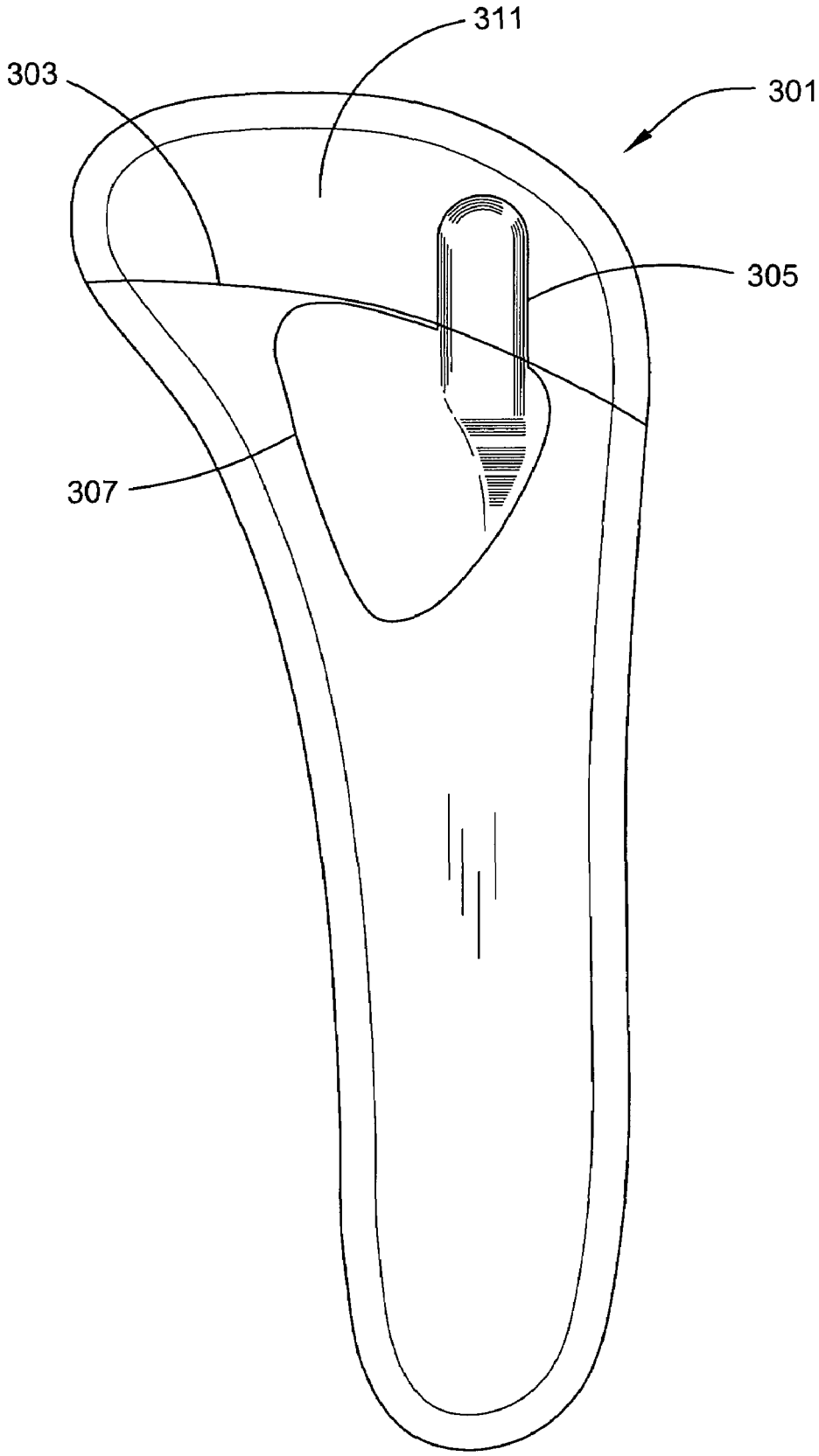
FIGS. 16 and 17 are plan views of other embodiments of insoles this invention.

FIG. 16 shows an insole embodiment similar to the insole in FIG. 15 except that the insole, generally designated 301, has a cut line 303 which extends across the neuroma section 305 of the metatarsal pad 307. This particular design provides even more space for the foot when the portion 311 of the insole forward of the line 303 is removed, while also providing some cushioning and protection against neuromas.

Figure 17:
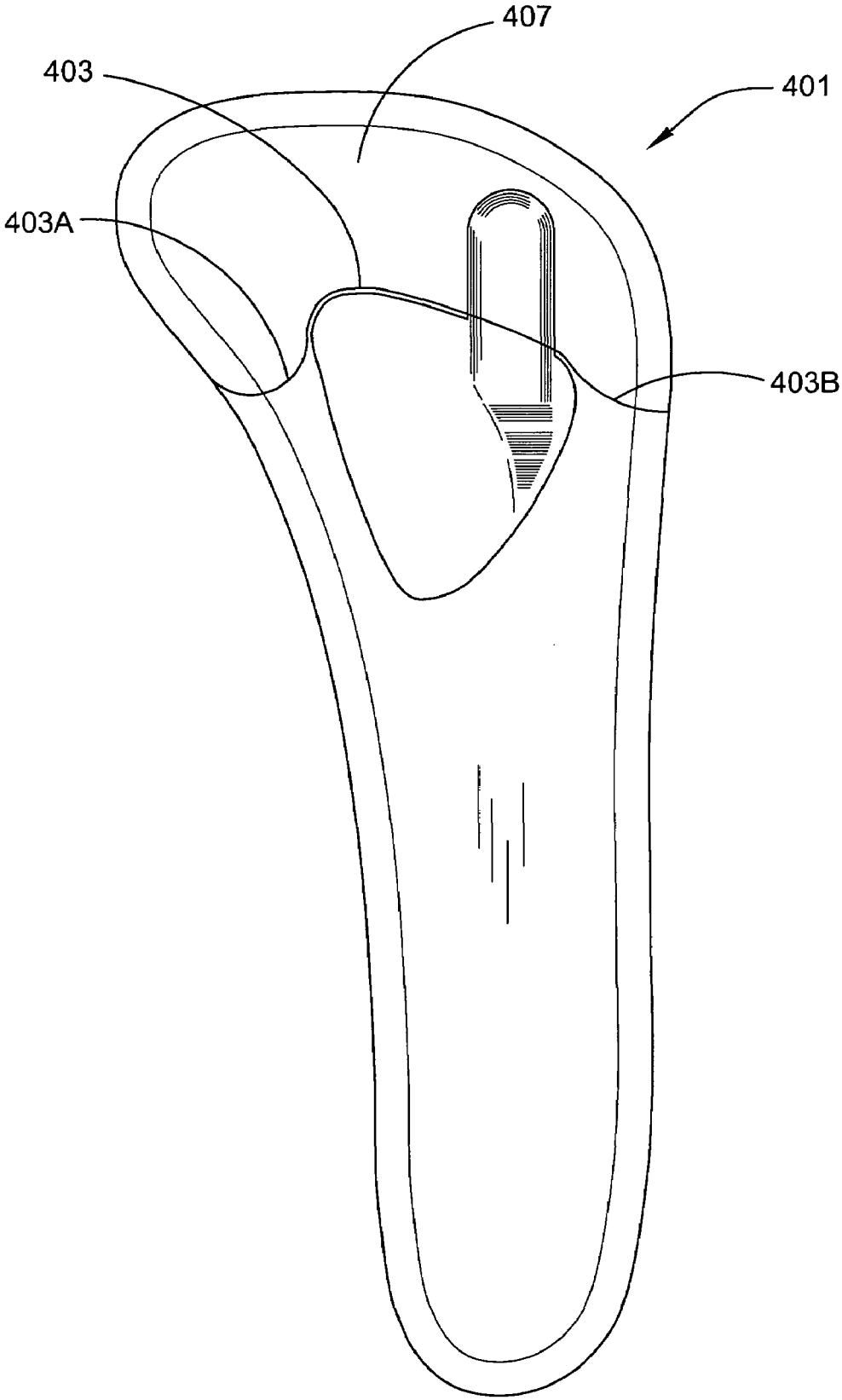

FIG. 17 shows an insole, generally designated 401, similar to the insole 301 in FIG. 16 except that the cut line 403 is modified to extend rearward of the first and fifth metatarsal necks, as indicated at 403A and 403B, respectively. As a result, when the portion 407 of the insole forward of the line 403 is removed, the first metatarsal head of the foot is able to plantarflex through a greater range of movement, and more room for the foot is provided in the area of the fifth toe, which may be cramped for space in some shoes with smaller toe boxes.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. An insole formed for relieving pressure on a third common digital nerve of a foot, comprising a heel section, a mid section, a forefoot section, and a pad on the forefoot section comprising a metatarsal pad section having a front edge adapted to underlie one or more of the second, third and fourth metatarsal necks of the foot, and a neuroma pad section projecting forward from said front edge of the metatarsal pad section between the third and fourth metatarsal heads, said neuroma pad section having a width such that it underlies adjacent portions of the third and fourth metatarsal heads of the foot but does not underlie the second and fifth metatarsal heads of the foot whereby when a bottom of the foot is placed on the insole, the neuroma pad section applies an upward force to the bottom of the foot sufficient to spread the third and fourth metatarsal heads away from one another and thereby relieve pressure on said third common digital nerve between said third and fourth metatarsal heads.

2. An insole as set forth in claim 1 wherein said neuroma pad section has a width less than the combined widths of said third and fourth metatarsal heads.

3. An insole as set forth in claim 1 wherein said neuroma pad section is elongate and extends forward from the metatarsal pad section beyond the metatarsal phalangeal joints of the third and fourth metatarsals.

4. An insole as set forth in claim 1 wherein said neuroma pad section is generally rectangular in shape and projects in a direction generally parallel to the third and fourth toes.

5. An insole as set forth in claim 1 wherein the neuroma pad section has a width only slightly more than the spacing between the third and fourth metatarsal heads.

6. An insole as set forth in claim 1 wherein said insole and said pad are molded as an integral unit.

7. An insole as set forth in claim 1 wherein said insole has a skived peripheral edge.

8. An insole as set forth in claim 1 wherein said insole has a bottom surface formed with cushioning elements thereon.

9. An insole as set forth in claim 8 wherein said cushioning elements cover substantially the entire bottom surface of the insole.

10. An insole as set forth in claim 8 wherein said cushioning elements have an inherent anti-slip characteristic to hold the insole in place when placed in footwear.

11. An insole as set forth in claim 1 wherein said insole has a bottom surface with anti-slip characteristics.

12. An insole as set forth in claim 11 wherein said insole bottom surface has textured areas to provide said anti-slip characteristics.

13. An insole as set forth in claim 1 further comprising one or more cut lines indicating where the insole can be cut to accommodate feet of different size.

14. An insole as set forth in claim 13 wherein said one or more cut lines are on the heel and the forefoot sections of the insole.

15. An insole as set forth in claim 1 wherein the front edge of said metatarsal pad section underlies said second, third and fourth metatarsal necks of the foot, and wherein said neuroma pad section has opposite sides extending forward from said front edge of the metatarsal pad section.

16. An insole as set forth in claim 1 wherein the neuroma pad section has a width greater than the spacing between the third and fourth metatarsal heads but less than a distance across the third and fourth metatarsal heads.

17. An insole as set forth in claim 16 wherein the neuroma pad section has a planar top surface.

18. An insole as set forth in claim 17 wherein the neuroma pad section has opposite side edges inclined inwardly from bottom to top.

* * * * *